US006034654A

United States Patent [19]

Zorzan et al.

[11] Patent Number: 6,034,654

[45] Date of Patent: Mar. 7, 2000

[54] METHOD FOR THE CONTROL OF AN IMAGE DISPLAY SCREEN USING THE PRINCIPLE OF THE MODULATION OF DURATION OF LIGHT EMISSION AND DISPLAY DEVICE IMPLEMENTING THE METHOD

[75] Inventors: Philippe Zorzan, Grenoble; Eric Benoit, Eybens, both of France

[73] Assignees: Thomson-CSF, Paris; Thomson Multimedia, Courbevoie, both of France

[21] Appl. No.: 08/803,282

[22] Filed: Feb. 20, 1997

[30] Foreign Application Priority Data

Feb. 27, 1996 [FR] France ..... 96 02394

[51] Int. Cl.[7] ..... G09G 3/28

[52] U.S. Cl. ..... 345/60; 345/63

[58] Field of Search ..... 345/60, 63, 95, 345/96, 97, 100, 148

[56] References Cited

U.S. PATENT DOCUMENTS

| | | | |
|---|---|---|---|
| 5,151,690 | 9/1992 | Yamazaki | 345/96 |
| 5,162,932 | 11/1992 | Kobayashi et al. | 345/96 |
| 5,233,447 | 8/1993 | Kuribayashi et al. | 345/97 |
| 5,642,128 | 6/1997 | Inoue | 345/97 |

FOREIGN PATENT DOCUMENTS

| | | |
|---|---|---|
| 0 444 962 A3 | 9/1991 | European Pat. Off. . |
| 0 674 303 A3 | 9/1995 | European Pat. Off. . |

*Primary Examiner*—Vijay Shankar
*Attorney, Agent, or Firm*—Oblon, Spivak, McClelland, Maier & Neustadt, P.C.

[57] ABSTRACT

A method for the control of a display screen whose pixels are cells producing light is used to minimize certain image defects known as excess brightness defects caused by major variations in the number of cells activated. For this purpose, the invention operates on the sub-division of the activation times of the cells during a given cycle time to reduce a time during which cells, selected as a function of their luminance level, are the only ones to be activated. The disclosed method can be applied especially to the control of alternating type plasma panels.

13 Claims, 6 Drawing Sheets

| VIDEO INPUT | S8B | S8A | S7 | S6 | S5 | S4 | S3 | S2 | S1 |
|---|---|---|---|---|---|---|---|---|---|
| 0 | 0 | 0 | 0 | 0 | 0 | 0 | 0 | 0 | 0 |
| 127 | 0 | 0 | 1 | 1 | 1 | 1 | 1 | 1 | 1 |
| 128 | 0 | 1 | 1 | 0 | 0 | 0 | 0 | 0 | 0 |
| 191 | 0 | 1 | 1 | 1 | 1 | 1 | 1 | 1 | 1 |
| 192 | 1 | 1 | 1 | 0 | 0 | 0 | 0 | 0 | 0 |
| 255 | 1 | 1 | 1 | 1 | 1 | 1 | 1 | 1 | 1 |

13

(Y1)

(Y2)

(Y3)

(Y4)

to
t1
t2
t3
t4
t5
t6
t7
t8
V2
V0
V1
tp
tn
tne
CI
P

METHOD FOR THE CONTROL OF AN IMAGE DISPLAY SCREEN USING THE PRINCIPLE OF THE MODULATION OF DURATION OF LIGHT EMISSION AND DISPLAY DEVICE IMPLEMENTING THE METHOD

BACKGROUND OF THE INVENTION

1. Field of the Invention

The invention relates to a method for the control of display screens using the principle of modulation of the duration of light emission to display half-tones. It can be applied to screens where the pixels are constituted by cells working with two stable states and having a memory effect. The invention also relates to an image display device implementing the method.

The term "memory effect" is understood to mean the effect by which cells maintain either of two stable states when a signal having activated the state has disappeared.

2. Description of the Prior Art

Display screens of this kind are constituted for example by plasma panels (abbreviated as PP) of the direct current type with memory or the alternating current type, or again for example by screens whose elementary cells use a "point effect" phenomenon so that each one of them produces an electron beam.

In the case of alternating type PPs, the electrodes are covered with a dielectric material in such a way that, since they are not in contact with the gas, electrical charges collect on the dielectric at each discharge in the gas.

These charges persist at the end of the discharge and their presence in a cell then makes it possible to prompt a discharge in this cell by the application of a voltage lower than that which will be necessary in the absence of these charges. This constitutes the "memory effect" already referred to. The cells that possess such charges are said to be in the "lit" or ON state. The other cells which require a higher voltage to produce a discharge are said to be in the "extinguished" or OFF state.

This memory effect is used by means of alternating signals called sustaining signals, applied to all the cells to activate those that are in the "ON" state, namely to prompt so-called sustaining discharges in these cells that produce light without modifying their "ON" state or modifying the state of the cells that are in the "OFF" state.

All the so-called "alternating" PPs benefit from the above-described memory effect.

Certain alternating PPs use only two intersecting electrodes to define and activate a cell, as described for example in the French patent published under No. 2 417 848. In this case, the two intersecting electrodes are used to obtain both the addressing operation (namely the placing of the cell in the "ON" or the "OFF" state) and the sustaining discharges.

Reference may also be made to the "coplanar sustaining" type of alternating PPs, such as those known especially in the European patent document EP-A-0 135 382. In these PPs, each cell is defined at the intersection between a so-called addressing electrode and a pair of parallel electrodes. The sustaining discharges are carried out by means of the two parallel electrodes and the addressing is done by means of one of these two electrodes and the addressing electrode.

In the different types of PPs which show a memory effect, all the cells are supplied in parallel. The large number of cells possible may therefore lead to high currents and the supply of the cells may then show defects that generate defects of the image.

The authors of the invention have thought that the defects in the supply of the cells, due in particular to amplifiers working at the limits of their characteristics, are aggravated by the principle of the control of the half-tone of the image.

Indeed, the elementary cell of a PP has only two states: the "ON" state and the "OFF" state. Since it is not possible to have a similar modulation of the quantity of light emitted by a pixel, namely by a cell, the production of the half-tones is obtained by modulating the period of emission of light from the pixels in an image period, or in other words by modulating the time during which the cell is placed in the "ON" state within the image period.

The control and supply of the cells of a PP are explained here below.

FIG. 1 gives a schematic view of an alternating PP. To simplify the description, this PP is of the type with two intersecting electrodes to define a cell as described in the French patent No. 2 417 848 referred to further above.

The PP has an array of electrodes Y1 to Y4 called "row electrodes" intersecting with a second array of electrodes X1 to X4 called "column electrodes". Each intersection of row and column electrodes corresponds to a cell C1 to C16. These cells are thus arranged in rows L1 to L4 and in columns; CL1 to CL4.

Each row electrode Y1 to Y4 is connected to an output circuit SY1 to SY4 of a row control device 1 and each column electrode C1 to C4 is connected to an output circuit SX1 to SX4 of a column control device 2.

The working of these two control devices 1, 2 is managed by an image management device 3.

Each output SY1 to SY4 of the row control device 1 delivers voltage square-wave signals that form the above-mentioned sustaining signals. These sustaining signals are thus applied simultaneously to all the row electrodes Y1 to Y4.

FIGS. 2*a* to 2*d* show sustaining signals applied respectively to the row electrodes Y1 to Y4. FIG. 2*a* particularly shows that the sustaining signals are formed by a succession of voltage square-wave signals set up on either side of a reference potential Vo which is often the potential of the ground. These square-wave signals vary between a negative potential V1 where they show one plateau and a positive potential V2 where they show another plateau. The reference potential Vo is applied to the column electrodes X1 to X4 in such a way that the application of the sustaining signals develops alternately positive and negative voltages at the terminals of the cells C1 to C16, for example voltages of 150 V that generate discharge in all the cells of the PP that are in the "ON" state.

These discharges occur at each reversal of polarity of the sustaining square-wave signals, namely at each positive transition Tp and negative transition Tn of these signals.

The placing of the cells in the "ON" or "OFF" states is done by addressing operations that are managed by the image management device 3. They may consist for example of the superimposition of specific signals of the addressing operation on the square waves of the sustaining signals. To this end, the row electrodes Y1 to Y4 are individualized, namely they are connected to an output circuit SY1 to SY4 proper to each of them, and each output circuit has, for example, a mixing circuit (not shown) by means of which it receives the sustaining signals and the addressing signals which come from different channels.

The sustaining signals have a period P that may be for example 10 microseconds, during which there address all the cells belonging to a selected row L1 to L4, namely all the cells defined by means of a selected row electrode Y1 to Y4.

Assuming that, at an instant to, there starts the addressing of the first row L1 corresponding to the row electrode Y1, the addressing may be for example of a type such that, at this instant to, the signal applied to this electrode Y1 (and only to this electrode) is a negative erasure transition Tne, with a duration (shown in dashes) greater than that of the other transitions, that causes all the cells connected to this row electrode Y1 to be placed in the <<OFF>> state. Then, at an instant t1 when the signal has its positive plateau, a so-called recording square-wave signal C1 (shown in dashes) is superimposed (on the positive side) on this plateau. This recording square-wave signal has the effect of placing all the cells connected to this row electrode in the "ON" state except those whose column electrodes X1 to X4 deliver a so-called "masking" signal (not shown) which has the effect of inhibiting the effects of the recording square-wave signal CI.

This operation may be repeated at each of the following periods of the sustaining signals at the instants t2 and t3, t4 and t5, t6 and t7 at which the operations for addressing the rows L2, L3, L4 corresponding respectively to the row electrodes Y2, Y3, Y4 are thus made. At the instant t8, a new addressing of the first row L1 is carried out.

These addressing operations, performed successively for each row L1 to L4 of the screen, constitute a sub-scanning operation, and several sub-scanning operations are performed during an image cycle time or image period in order to obtain the half-tones of the image by placing the cells C1 to C16 of each row L1 to L4 in the "ON" state or the "OFF" state at each sub-scanning operation.

To this end, the image period PI is sub-divided into n sub-periods S1, S2, . . . , Sn of different duration, respectively equal to To, 2To, . . . , $2^n-1$ To, with To=PI/$2^n-1$.

FIG. 3 illustrates the division of the image period PI into n sub-periods S1, S2, . . . , Sn with n equal to 4 in the example. The image period PI starts at the instant to with a first sub-period S1 that lasts for a period of time To and ends at an instant Ta. A second sub-period S2 starts at the instant ta and lasts for a period of time equal to 2To, ending at an instant tb at which a third sub-period S3 starts. The third sub-period S3 lasts for a period of time equal to 4To and ends at an instant tc. A fourth sub-period S4 starts at the instant tc and lasts for a period of time equal to 8To up to the end of the period PI which marks the instant to' of a following image period.

With an image period PI equal to 20 ms for example, the sub-periods S1, S2, S3, S4 respectively have a duration of the order of 1.33 ms, 2.66 ms, 5.33 ms and 10.66 ms.

Thus, in the example of FIG. 3, it is possible to address each row L1 to L4 four times during the image period of this row, at the instants to, ta, tb and tc. It is therefore possible, for each row L1 to L4, to place each cell C1 to C16 in the "OFF" state or the "ON" state at each of these instants, namely at each start of the sub-periods S1 to Sn, and each cell preserves this state up to the beginning of the next sub-period when it is again placed in either of the two states, namely the "OFF" state or the "ON" state.

The cells that have been placed in the "ON" state by the beginning of one or more sub-periods S1 to Sn are activated by the sustaining signals and produce light for the duration of this sub-period or these sub-periods. It is therefore possible, by the combination of the n sub-periods S1 to Sn, to obtain $2^n-1$ different periods of emission of light by each cell. Each period corresponds to a desired luminance level for this cell during the image period PI. In addition, there is a period corresponding to the zero luminance level which corresponds to the case of a cell that is placed in the "OFF" state for all the periods S1 to Sn of this image period.

Thus, in the example of FIG. 3, the luminance level of a cell placed in the "ON" state, namely a cell activated solely during the first sub-period S1, is ⅕th of the luminance level activated during the first and third sub-periods S1, S3 and 1/15th of the luminance level activated during the entire image period PI.

This principle of the control of the luminance levels of the cells of a row L1 to L4 can be applied to all the rows, of course with a time lag from one row to another. For example, the principle can be applied from a row L1 to the following row L2 with a lag that corresponds to a sustaining signal period p as shown in FIG. 2 which may, for example, be in the range of 10 microseconds. In fact, the image period PI has one and the same duration for all the rows L1 to L4, irrespective of the number N of these rows with a time lag for example of one period between two consecutive rows. This lag is seen again in the sub-division of the sub-periods S1 to Sn.

It must be noted that the luminance levels desired for the different cells of each row L1 to L4 correspond to video input luminance values that are encoded and stored in the image management device 3, generally by means of n bits of different values of significance, each corresponding to one of the sub-periods S1 to Sn.

Since the cells C1 to C16 in the "ON" state are activated by the sustaining signals delivered by the row control device 1, they constitute a load applied to this device.

The sustaining signals may be prepared in different ways that are known per se. In any case, the row control device has at least one amplifier A for this purpose. This amplifier A delivers the sustaining signals to the output circuits SY1 to SY4 either directly as shown in FIG. 1 or by means of several output stages (not shown) each assigned to the supply of several output circuits, namely several row electrodes Y1 to Y4.

In the example of FIG. 1, only four row electrodes and four column electrodes are shown but a PP may actually have more than a thousand electrodes of each of these types, which define more than a million cells.

Consequently, the sustaining signals delivered by the amplifier A must be delivered by the amplifier at a current that may vary considerably as a function of the contents of the image, namely as a function of the number of cells that are in the "ON" state. Given the non-zero source impedance values of the amplifier A, as well as the impedance values of access to the cells (related in particular to the inductance and resistance values of the printed circuit tracks and the connections etc.), the quantity of charges really applied to a given cell C1 to C16 depends on the total content of the image. In other words, the greater the load applied to the amplifier A, the greater is the reduction in the luminance of the <<ON>> cells forming this load.

This variation of luminance as a function of the contents of the image can be seen especially in the case shown in FIG. 4 which represents an image that is formed chiefly by a low-luminance peripheral zone Z1 and a second high-luminance zone Z2 and has a constant encoding of video luminance value. A major variation of luminance displayed can be observed as a function of the variation of the surface area of the second zone Z2.

To this defect of the image, there is added another defect related to an excess brightness defect. This defect consists especially of an exaggeration and even a reversal of the differences in luminance between zones. Here, reference is made again to FIG. 4, assuming that the second zone Z2 is formed by two contiguous surfaces R1, R2, the second one R2 of which is located at the center of the first one R1 and assuming that it is desired to display luminance values that are different but close to each other on these two surfaces, for example a luminance I2 corresponding to a video luminance encoding equal to 128 (in the case of a video luminance encoding on 8 bits, namely with eight sub-periods as explained here above), for the second surface R2 and a luminance I1 encoded 127 for the first surface R1.

An exaggeration and a reversal of the difference in luminance displayed by these two surfaces R1, R2 can be observed in the image: instead of a theoretical ratio I2/I1 of 1.008 (128/127=1.008), in fact a real ratio is obtained with a value that may be 0.54.

Furthermore, if the first surface R1 is made to vary, all else being equal, a variation is noted in the luminance values I1 and I2. This variation shows that the luminance I2 of the second surface R2 is dependent on the contents of the rest of the image outside this surface R2.

A known approach used to correct these defects consists in diminishing the impedance values of sources and the impedance values of connections, and the impedance values presented by the electrodes themselves. This is obtained by a choice and selection of the components and by drawing and preparing the paths of the discharging currents with special care and also by increasing the number of channels provided for the discharge currents (especially by the parallel connection of several power transistors at the sustaining signal amplifier or amplifiers, such as the amplifier A, as well as in the output circuits, such as the circuits SY1 to SY4).

However, the improvements that result therefrom are only partial and, at the same time, very costly for the number of components and/or their individual cost is greatly increased. There is also an increase in both space requirement and manufacturing complexity, and hence an increase in cost.

SUMMARY OF THE INVENTION

The present invention is aimed at reducing the image defects related to major variations in the load and more particularly at reducing the defects of excess brightness described here above. To this end, it proposes a low-cost solution which consists in acting on the sub-division of the activation time of the cells within an image period.

The invention relates to a method for the control of a display screen whose pixels are cells arranged in rows and columns. The cells are placed either in a state known as an "OFF" state or in a state known as an "ON" state in which they are activated and produce light. The method consists, for each row and during a given cycle time, in placing each cell in the "OFF" state or the "ON" state at each beginning of n time intervals of different duration called activation sequences as a function of a luminance level to be displayed by each cell for said cycle time. The method consists, for at least one row, in defining at least one range of luminance levels whose lower limit corresponds to the duration of an activation sequence and in dividing this sequence into at least two subsequences and then, for the activation of the cells having a luminance level included in said range, in replacing this activation sequence by at least one activation sequence with a shorter duration to which one of the two sub-sequences is added.

This makes it possible, in a large proportion of the image configurations liable to have defects of excess brightness, to reduce the time during which, for one row of cells, a small number of cells in the "ON" state immediately follows (or precedes) a large number of cells, and therefore makes it possible to obtain a reduction, in one and the same ratio, of the excess brightness defect in particular.

The invention also relates to an image display device having cells arranged in rows and columns, the cells being either in an "OFF" state or in an "ON" state in which they are activated and produce light, the cells being capable of undergoing activation during activation times whose duration differs as a function of a luminance level that they must each display during a given cycle time, wherein said display device comprise means for the sub-division, within said cycle time, of the activation times of cells of at least one row having luminance levels within a given range so as to reduce the time during which these cells are liable to be the only ones to be activated.

BRIEF DESCRIPTION OF THE DRAWINGS

The invention will be understood more clearly from the following description, given by way of a non-restricted example, with reference to the appended drawings, of which.

MORE DETAILED DESCRIPTION

Figure 4:
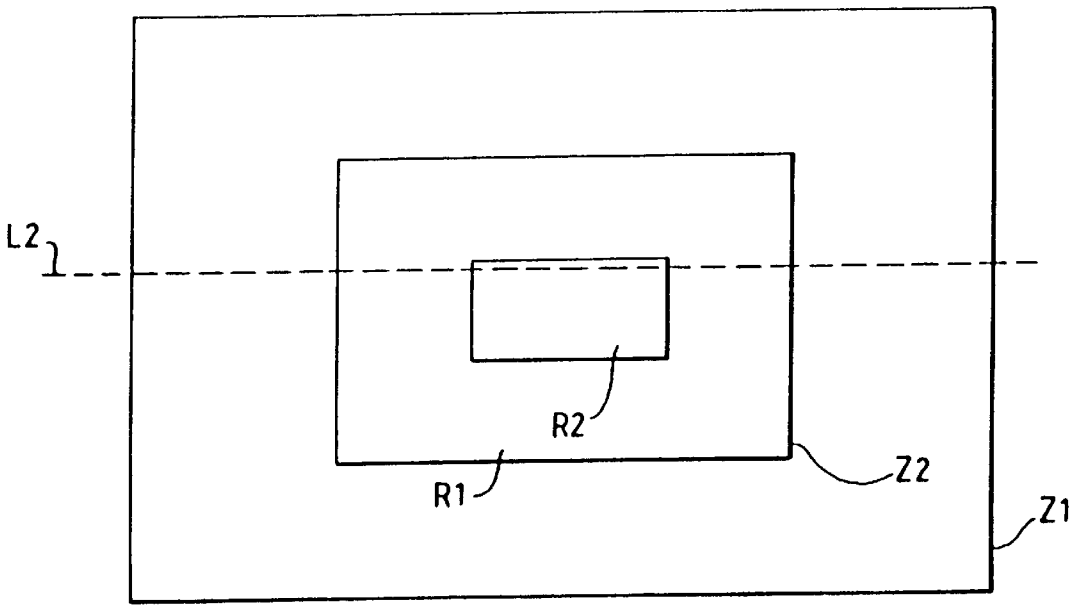
FIG. 4, already described, shows an image configuration capable of introducing defects into the image.
Figure 5:
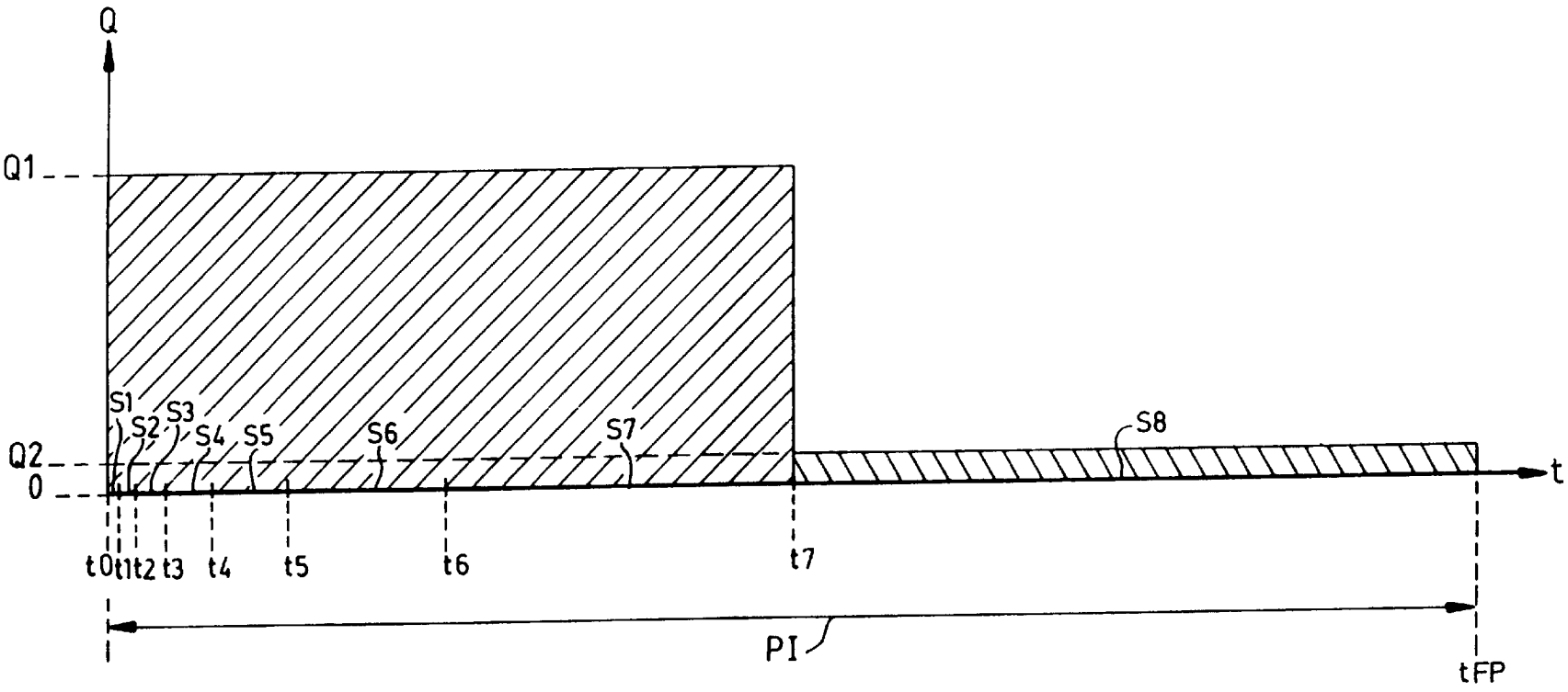
FIG. 5 shows the progress, during an image period, of the load constituted by cells in the "ON" state activated by a prior art method.

FIG. 5 shows the progress, during an image period PI (equal to 20 ms for example) of the load constituted by the cells (C1 to C16) of a row such as the second row L2 for example shown in FIG. 4, in a typical case with a defect of excess brightness and under the control of a prior art method.

In such a case, there is a major imbalance between the number or cells (C1 to C16) having a luminance level equal to or lower than, for example, the level 127, than the number of cells having a level equal to or greater than 128. This is a fairly frequent case in facial images where a few points only of the image have a luminance level greater than 127. It is assumed in this example that, in FIG. 4, the first zone Z1 and the first surface R1 represents 90% of the cells and have a luminance level 127, and that the second surface R2 has a luminance level 128 and represents 10% of the cells of the row L2.

For the above conditions, and under the control of a prior art method, using eight activation sequences S1 to S8, the development of the load constituted by the row L2 is shown in FIG. 5.

At the instant to, when the image period PI starts, there also starts the appearance of the first activation sequence S1 with which the cells with a luminance level 127 are placed in the "ON" state and are therefore activated. The result thereof is that, at the instant to, the load Q of the row L2 has a first value Q1. These same cells are also activated by the following activation sequences S2, S3, S4, S5, S6, S7 which succeed each other at the instants t1, t2, t3, t4, t5, t6. As in the above explanations, the duration of each of these activation sequences is half the duration of the activation sequence that follows. Consequently, the luminance level encoded 127 is reached at the end of the seventh activation period S7 at the instant t7, and the load keeps the first value Q1 up to this instant t7.

From the instant t7 onwards, the cells with a luminance encoded 127 are OFF and the cells with a luminance encoded 128 are placed in the "ON" state with the start of the eighth activation sequence S8 for the duration of this sequence (which is equal to 128 times the duration of the first activation period S1). Consequently, the load varies sharply at the instant t7 where it goes from the value Q1 to a second value Q2 which is far lower (about nine times lower in the example).

The load with the value Q2 is kept till the end of the eighth activation sequence S8 which stops with the end of the image period PI, at an instant tFP.

In the example shown in FIG. 5, the difference in the value of load between the time interval formed between the instants to and t7 and the time interval formed between the instants t7 and tFP will make the pixels or cells encoded at 128 "over-bright" as compared with the cells encoded at 127.

Figure 6A:
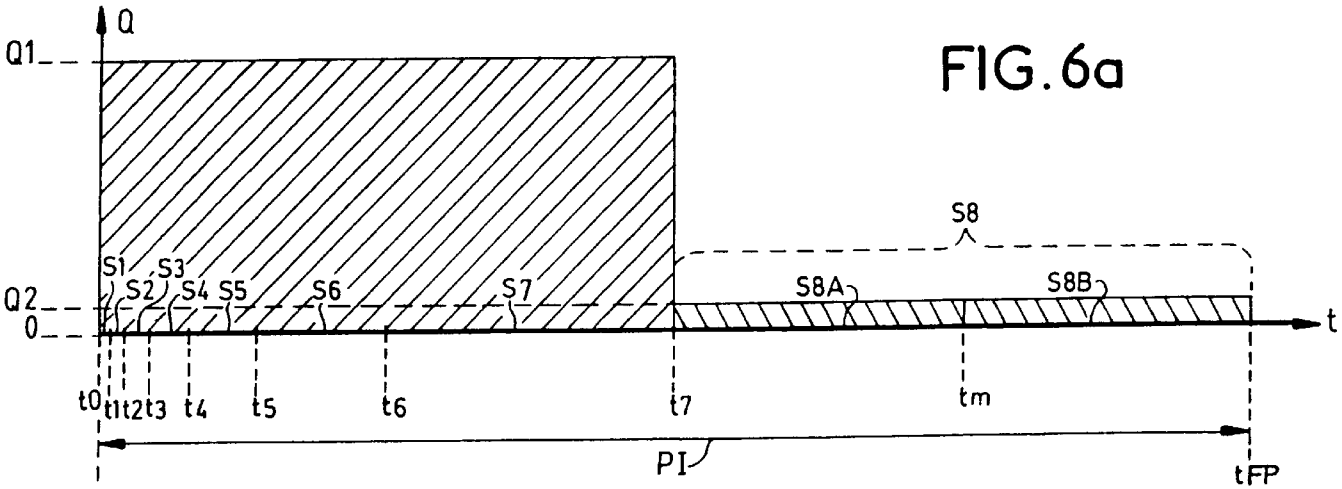
FIG. 6*a* illustrates a step of the invention that consists of the division into two sub-sequences of an activation sequence shown in FIG. 5.
Figure 6B:
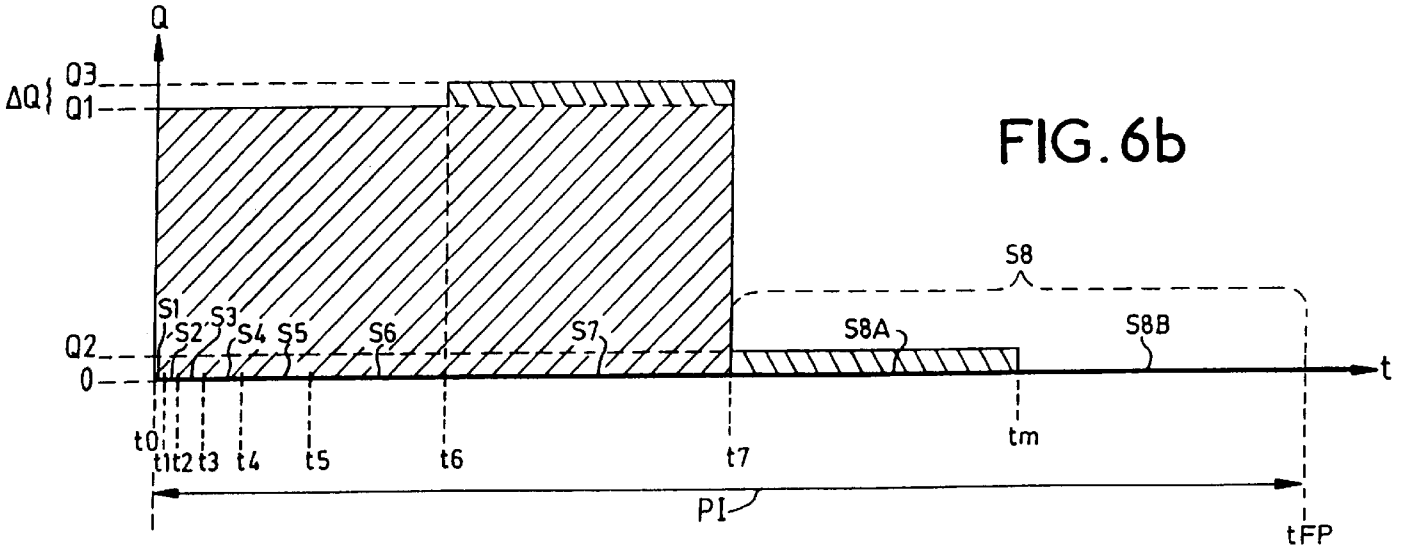
FIG. 6*b* shows the progress, during an image period, of the load constituted by cells in the "ON" state activated by the method of the invention.

FIGS. 6*a* and 6*b* illustrate the operation and the advantage that result from the implementation of the invention. For a clearer understanding of the invention, FIG. 6*a* also shows the development of the load of the row L2 under the same conditions as those already explained with reference to FIG. 5. However, as compared to FIG. 5, it also shows a characteristic of the invention in which the eighth activation sequence S8 is sub-divided into two sub-sequences S8A and S8B.

In the non-restricted example described, the two sub-sequences S8A and S8B are equal so that there are now three time intervals having the same significance, namely having identical duration, the duration of all three being equal to 64. These three intervals are: the seventh activation sequence S7 contained between the instants t6 and t7; the first sub-sequence S8A contained between the instant t7 and an instant tm (an instant tm which sub-divides the duration of the eighth sequence S8 into equal parts); and the second subsequence S8B contained between the instant tm and the instant tFP of the end of the image period PI.

The principle then consists of the use of the seventh activation sequence S7 instead of the second sub-sequence S8B for the partial restitution of the luminance of the cells encoded at 128. This means that the cells encoded at 128 will be placed in the "ON" state during the seventh activation sequence S7, at the same time as the cells encoded at 127.

FIG. 6*b* shows the way in which the implementation of the invention is manifested on the load Q of the row L2 of cells for the same conditions of luminance of the cells as in the example of FIGS. 5 and 6*a*.

At the instant to, when the application starts as soon as the first activation sequence S1, the load Q acquires the same high first value Q1 as it had at this same instant to in the examples of FIGS. 5 and 6*a*. The following activation sequences S2, S3, S4, S5, S6 are applied as above at the instants t1, t2, t3, t4, t5.

The instant t6 marks the end of the sixth activation sequence S6 and the beginning of the seventh activation sequence S7.

At the instant t6, with the seventh activation sequence S7, not only is the activation of the cells having the level 127 continued but, unlike in the prior art, it is also the cells having the luminance level 128 that are activated. In other words, these cells are put in the "ON" state (while in the prior art they were activated only later, starting from the instant t7).

Consequently, starting from the instant t6, the row L2 has more activated cells and its load increases at the instant t6 by a quantity ΔQ, goes to a third value Q3 (higher than the first value Q1) and keeps this value Q3 up to the instant t7 where the seventh activation sequence S7 ends. The cells encoded with the luminance 127 then go to the "OFF" state that they keep up to the end of the image period PI.

However, at the instant t7, there also starts the first sub-sequence S8A which, at its beginning, resets the cells having the luminance level 128 in the "ON" state. The load Q then goes from the third value Q3 to the lower value Q2 which represents the load constituted solely by cells having the luminance level 128. This load value Q2 is kept up to the instant tm.

The instant tm, which separates the time interval contained between the instant t7 and the end of the image period PI into two equal parts, marks the end of the first sub-sequence S8A and the end of the activation of the cells encoded 128. These cells indeed have been activated during the seventh activation sequence S7 (equal to 64) plus the first sub-sequence S8A which too is equal to 64. Consequently, at the instant tm, the load goes to a value 0. Thus, for the activation of the cells having the luminance level 128, the eighth activation sequence S8 has been replaced by one of its sub-sequences plus the seventh sequence S7.

It is noted that the increase in load ΔQ at the instant t6 (due to the activation of the cells encoded 128) is low as compared with the first value of the load Q1 already displayed. This increase in load ΔQ therefore cannot significantly increase the defect of excess brightness due to the difference between the value of the load Q before the instant t7 and its value after the instant t7.

It is also observed that, after the instant t7, namely after the load Q has gone from the highest value Q3 to the lowest value Q2, the time during which the cells encoded 128 are activated corresponds to the duration of the first sub-sequence S8A, namely one-fourth of the image period PI, while in the example of FIG. 5 pertaining to the prior art, this time of activation of the cells encoded at the level 128 is equal to half of the image period PI and therefore has a given duration.

This time of activation of the cells having the luminance level 128, counted from the time when the load goes from a high value Q3 to a low value Q2, corresponds to the time during which the defect of excess brightness appears.

In this example, therefore, this defect has been reduced practically by half.

In the non-restrictive example described, the correction carried out by the method of the invention is applicable to luminance levels with a value 128 but it can be applied in the same way to other values corresponding to the change-over of a bit, namely to values that correspond to the duration of a single activation sequence S2, S3, S4, S5, S6, S7, S8 which respectively correspond to the value 2, 4, 8, 16, 32, 64, 128. For example, to set up the correction around the value 64, the seventh activation sequence S7 can be sub-divided into two equal half-sequences and, instead of the seventh activation sequence, it is possible to use one of its two half-sequences plus the sixth activation sequence S6.

If an activation sequence S2 to S8 is sub-divided into two sub-sequences of equal duration, it is possible without distinction to use either of them. For example, in the case described with reference to FIG. 6*b*, the first sub-sequence S8A could have been replaced by the second sub-sequence S8B of the same duration, in such a way that a part of the activation of the cells having the level 128 would have been produced between the instant tm and the end of the image period PI and not between the instant t7 and the instant tm.

However, it is possible also to sub-divide an activation sequence S3 to S8 into sub-sequences of unequal duration if they are equal to the shortest activation sequence S1 or to a multiple of this sequence. In such a case, by dividing for example the eighth activation sequence S8 which is equal to 128 into a first sub-sequence S8A' (not shown) with a value of 32 and a second sub-sequence S8B' (not shown) with a value of 96, the activation of the cells having a luminance level 128 must be produced at the same time as the activation of the cells whose level requires the use of the sixth activation sequence S6 (with a value 32) and then subsequently at the same time as the activation of the cells requiring the use of the seventh activation sequence S7 (equal to 64). Finally, they should be activated by the sub-sequence S8A' (with a value of 32).

Such modifications of the division of the activation times of the cells within an image period PI may be done around a value or several values of luminance levels. Such modifications may even relate to groups of luminance levels, or ranges of luminance levels, provided that the lower limit of a range is that of a luminance level corresponding to the duration of a single activation sequence S2 to S8 and that its upper limit is lower than the maximum luminance level.

It must be noted that, as compared with the prior art, the implementation of the method of the invention requires an additional addressing operation per sequence of activation that has been sub-divided. This addressing has to be done at the start of each second sub-sequence, namely in the example shown in FIG. 6, where only the eighth activation sequence S8 is subdivided into two sub-sequences, the addressing operation must be done at the beginning of the second sub-sequence S8B to place the cells having the value 128 in the OFF state. Naturally, an additional addressing of this kind constitutes an additional sub-scanning if it is repeated for all the rows L1 to L5 and it must be activated by the image management device 3 of the type shown in FIG. 1.

In fact, the general means used for the implementation of the invention already exist in an image management device used to activate a display screen.

Figure 7:
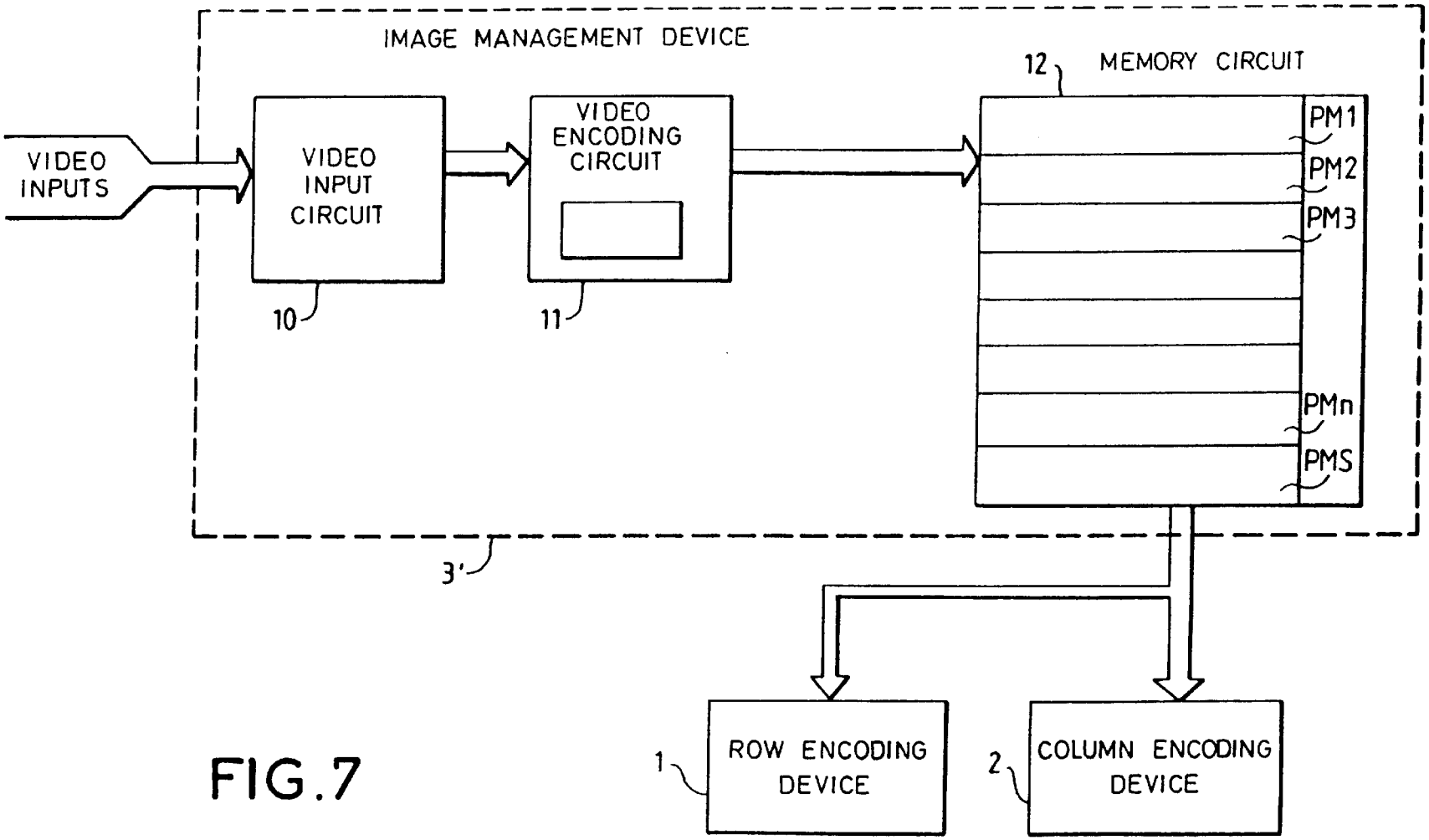
FIG. 7 gives a schematic view of an image management device enabling the implementation of the invention.

FIG. 7 gives a schematic view, by means of functional blocks, of some of the functions performed by an image management device 3 that is well known per se. It comprises, for example, a video input circuit 10 that carries out an adaptation of the video signals and classifies them for example for each row as a function of the luminance of each of the pixels, namely the cells of the row considered. The video input circuit 10 delivers video data elements that are applied to a video encoding circuit 11 which, as a function of the luminance levels assigned to the cells of a given row L1 to L4, carries out an encoding of each luminance. This makes it possible, by means of an encoding table, to define the different sequences of activation S1 to S8 by which each cell of a given row must be activated during an image period PI to restitute the desired luminance level.

The video encoding circuit 11 delivers encoded data elements to a memory circuit 12 which, for example, may have as many memory arrays PM1 to PMn as the number n of activation sequences S1 to S8. A memory array may thus correspond to each activation sequence. In this memory array, for each row, there are memorized the addresses of the cells that must be placed in the "ON" state. The memory circuit 12 consequently has knowledge of the number of the addressing operations (or sub-scanning operations) to be performed during an image period PI and, by the exchange of information with the row control and column control devices 1, 2 (shown in FIG. 1), it determines the performance of these addressing operations.

In view of the additional addressing by rows L1 to L4, dictated by the sub-division of the eighth activation sequence SB into two sub-sequences S8A and S8B, it may happen that an additional memory array PMS in the memory circuit 12 is required in particular to store the addresses of the cells to be deactivated or activated during the second sub-sequence S8B.

Figures 1, 8:
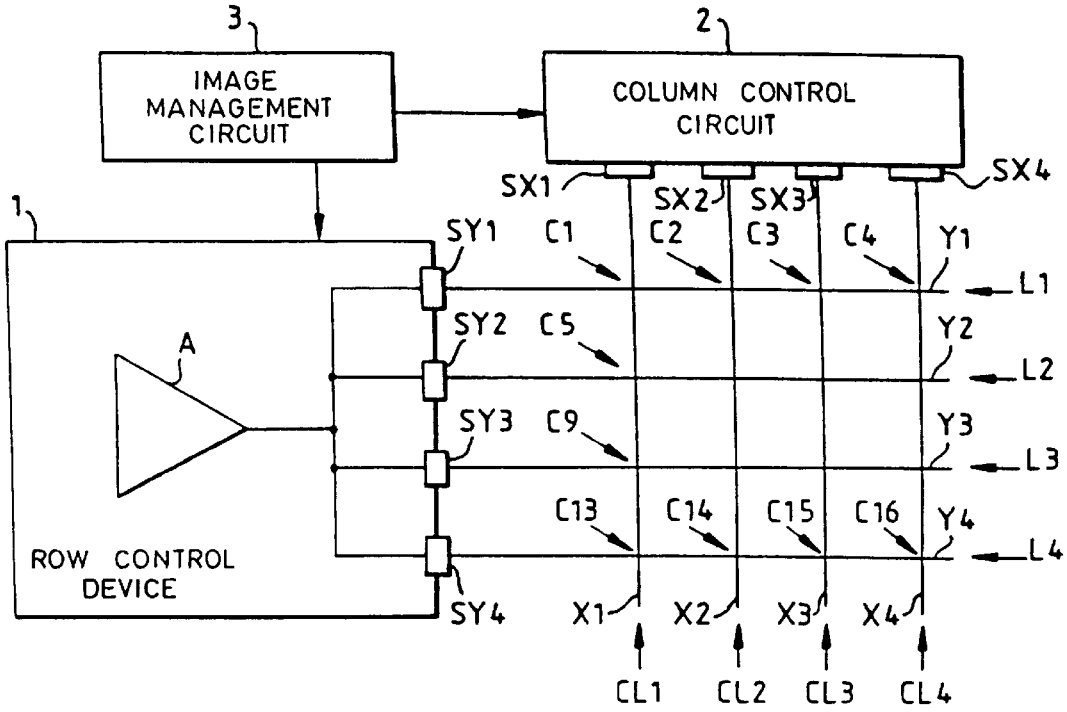
FIG. 1, already described, represents a plasma panel.
FIG. 8 shows an encoding table used in the image management device shown in FIG. 7.
Figures 2A, 2B, 2C, 2D, 2E:
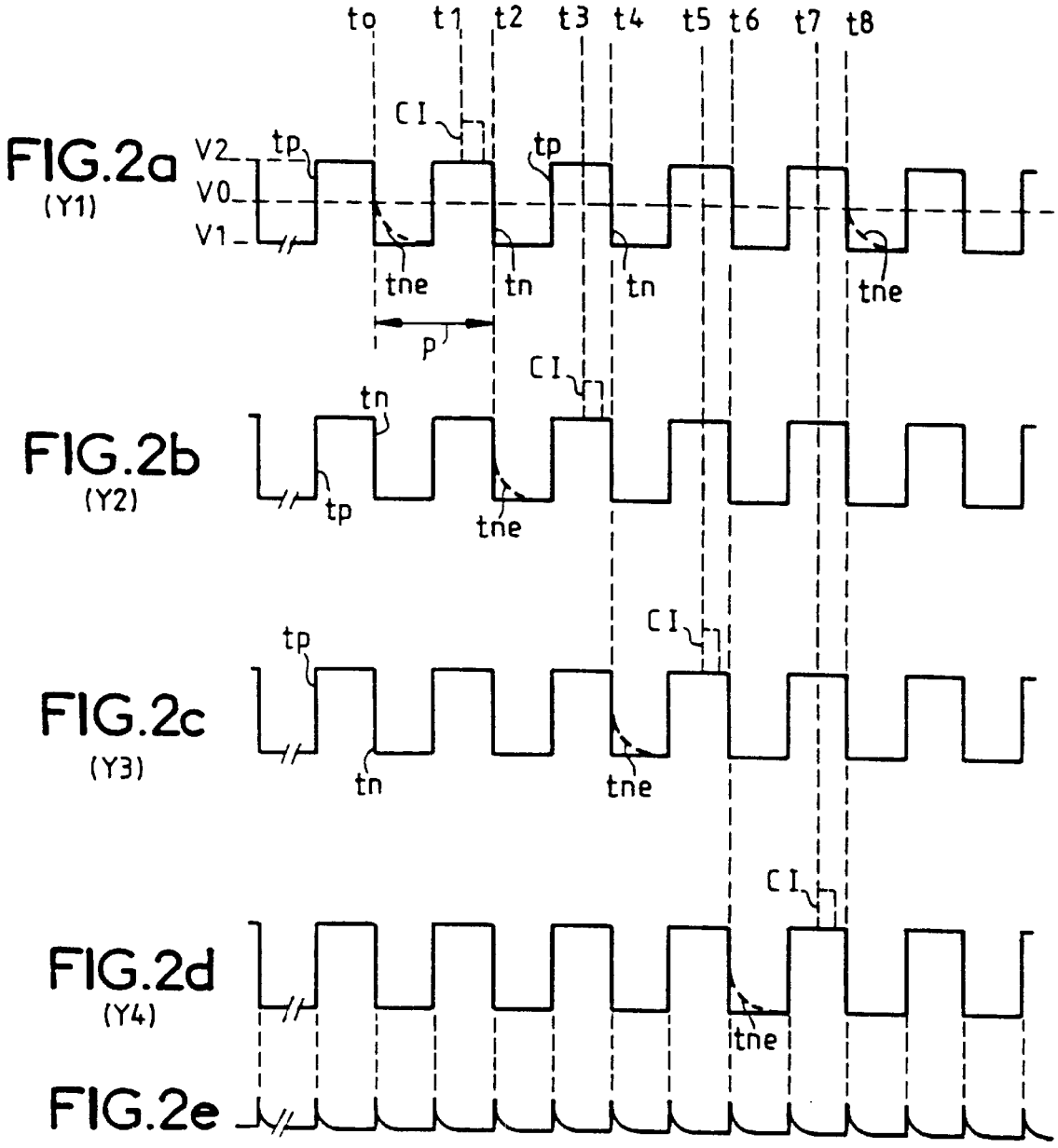
FIGS. 2*a* to 2*d*, already described, illustrate the working of cells of a plasma panel.
Figure 3:
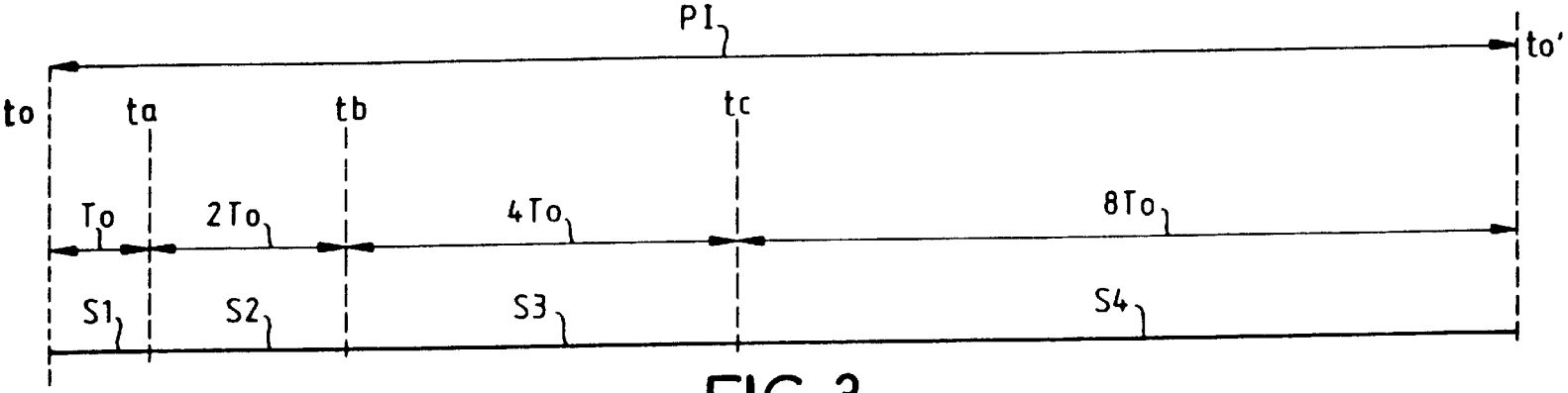
FIG. 3, already described, shows a division of an image period into n time intervals by which it is possible to obtain $2^n-1$ image half-tones.

FIG. 8 shows an encoding table 13 that can be used, in an encoding circuit 11, to assign certain sequences of the activation sequences S1 to S8 or all these activation sequences to the activation of the cells as a function of the level of luminance that they must each produce. The encoding table of FIG. 8 represents the example of FIG. 6*b* in which the eighth activation sequence S8 is sub-divided into subsequences S8A, S8B of equal duration, with a view to making corrections for the luminance levels from 128 to 191.

The left-hand side of the figure has a column called "video input". Each of the squares of this column gives a low luminance level and a high luminance value. Then, to the right, in descending order of significance, there are columns each corresponding to an activation sequence, namely: the eighth sequence S8 replaced in this exemplary embodiment of the invention by (in the following order) the second sub-sequence S8B and the first sub-sequence S8A; then the seventh activation sequence S7, then the sixth S6, the fifth S5, the fourth S4, the third S3, the second S2 and finally the first activation sequence S1. The squares of these columns show a 0 (zero) or a 1 depending on whether a cell must be in the "OFF" state or the "ON" state during the different corresponding sequences, as a function of the luminance level of the "video input" column.

This table shows that a cell that must restitute a luminance level 0 is "OFF" during the running of all the activation sequences and that, for a luminance level 127, it is "ON" during the seven sequences from S1 to S7, according to a standard configuration.

By contrast, from the luminance level 128 onwards, there is a difference for the prior art which lies in the fact that, to obtain the luminance level 128, the cell is placed in the "ON" state during the seventh activation sequence S7 as well as during a part of the eighth activation sequence S8 corresponding to the first sub-sequence S8A. Since the two sub-sequences S8A, S8B in this example have one and the same value 64 equal to that of S7, the sub-sequence S8B is replaced by the sequence S7 for all the levels of luminance greater than 127 or smaller than 192. The table indeed shows that this new configuration may be used up to the luminance level 191.

In the example described wherein the eighth activation sequence S8 is sub-divided into two subsequences S8A and S8B of equal value, it is necessary to find a standard configuration on the basis of the luminance level 192 (and up to the maximum level 255) which requires that a cell should be in the "ON" state throughout the seventh and eighth activation sequences S7, S8, the latter sequence S8 consisting of two parts S8A, S8B.

The example given in the table of FIG. 8 attempts to reduce the effect of excess brightness that affects a minority of cells in the "ON" state when there is a transition in a row L1 to L4 around the luminance level 128 between a large number of cells in the "ON" state and a small number of cells in the "ON" state. However, this method may work with other values of luminance corresponding to the change-over of a bit, for example 64, 32, etc., namely corresponding to a value of an activation sequence.

What is claimed is:

1. A method for controlling an image display screen having cells arranged in rows and columns, the cells being either in an "OFF" state or in an "ON" state in which they are activated and produce light, the method comprising for each row and during an image period:

dividing said image period into n activation sequences including a first activation sequence and a second activation sequence, said first activation sequence being longer than said second activation sequence;

subdividing the first activation sequence into first and second subsequences;

activating the cells by placing each cell in the "OFF" state or in the "ON" state at the beginning of each activation sequence, said cells including first cells to be displayed at a first luminance level and second cells to be displayed at a second luminance level lower than said first luminance level;

activating the first cells during the second activation sequence and during the first subsequence, said second activation sequence and said first subsequence corresponding to the first luminance level; and activating the second cells for a period of time corresponding to the second luminance level and including the second activation sequence such that the first and second cells are both activated during the second activation sequence.

2. A control method according to claim 1, further comprising:

performing, at each start of the first and second subsequences, an addressing operation enabling the cells to be placed in an "OFF" state or an "ON" state.

3. A control method according to claim 1, wherein the activation sequences have lengths of duration that increase from one to the other in a ratio of 2 so as to define, with n activation sequences, $2^n-1$ activation lengths of duration, each corresponding to one level of luminance.

4. A control method according to claim 1, wherein said first and second luminance levels are lower than a maximum level of luminance attainable by the cells.

5. A control method according to claim 1, wherein the first and second subsequences are of equal duration.

6. A control method according to claim 1, wherein the first and second subsequences are of unequal duration.

7. A control method according to claim 1, wherein the display screen is a plasma panel.

8. An image display device comprising:

an image display screen including a row of cells, the cells being either in an "OFF" state or in an "ON" state in which they are activated and produce light; and an image management unit cooperating with a row control device and a column control device to divide an image period into n activation sequences, said activation sequences including a first activation sequence and a second activation sequence, said first activation sequence being longer than said second activation sequence, said image management unit comprising:

means for subdividing the first activation sequence into first and second subsequences;

means for activating the cells by placing each cell in the "OFF" state or in the "ON" state at the beginning of each activation sequence, said cells including first cells to be displayed at a first luminance level and second cells to be displayed at a second luminance level different from said first luminance level;

means for activating the first cells during the second activation sequence and during the first subsequence, said second activation sequence and said first subsequence corresponding to the first luminance level; and means for activating the second cells for a period of time corresponding to the second luminance level and including the second activation sequence such that the first and second cells are both activated during the second activation sequence.

9. A display device according to claim 8, wherein the image management device comprises:

a video encoding circuit cooperating with the n memory arrays to activate the placing, in the "OFF" state or the "ON" state, of each cell of each row at the start of each activation sequence in order to obtain activation times corresponding to the luminance of each cell, and wherein said device further comprises:

at least one additional memory array to obtain at least one additional addressing operation corresponding to the subdivision of the first activation sequence.

10. A display device according to claim 9, wherein the video encoding circuit comprises:

an encoding table that defines a range of luminance levels and that cooperates with the memory arrays to subdivide the activation times of the cells within said image period.

11. A display device according to claim 9, wherein the n activation sequences have lengths of duration that increase from one to the other in a ratio of 2 so as to obtain, by their combination, $2^n-1$ different lengths of duration.

12. A display device according to claim 8, wherein the image display screen is a plasma panel.

13. An image display device for controlling an image display screen including a row of cells, the cells being either in an "OFF" state or in an "ON" state in which they are activated and produce light, comprising:

means for dividing an image period into n activation sequences, said activation sequences including a first activation sequence and a second activation sequence, said first activation sequence being longer than said second activation sequence;

means for subdividing the first activation sequence into first and second subsequences;

means for activating the cells by placing each cell in the "OFF" state or in the "ON" state at the beginning of each activation sequence, said cells including first cells to be displayed at a first luminance level and second cells to be displayed at a second luminance level different from said first luminance level;

means for activating the first cells during the second activation sequence and during the first subsequence, said second activation sequence and said first subsequence corresponding to the first luminance level; and means for activating the second cells for a period of time corresponding to the second luminance level and including the second activation sequence such that the first and second cells are both activated during the second activation sequence.

* * * * *